US008746862B2

(12) United States Patent
Karasawa et al.

(10) Patent No.: US 8,746,862 B2
(45) Date of Patent: Jun. 10, 2014

(54) LIQUID CONTAINER AND LIQUID DETECTING SYSTEM

(75) Inventors: Masahiro Karasawa, Matsumoto (JP); Yuji Aoki, Matsumoto (JP); Masaru Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/495,140

(22) Filed: Jun. 13, 2012

(65) Prior Publication Data

US 2012/0314008 A1 Dec. 13, 2012

(30) Foreign Application Priority Data

Jun. 13, 2011 (JP) ..... 2011-130991

(51) Int. Cl.
*B41J 2/175* (2006.01)

(52) U.S. Cl.
USPC ..... 347/86; 347/85; 347/87; 347/49

(58) Field of Classification Search
USPC ..... 347/84–86
See application file for complete search history.

(56) References Cited

U.S. PATENT DOCUMENTS

| | | | | |
|---|---|---|---|---|
| 4,604,633 | A | 8/1986 | Kimura et al. | |
| 4,973,993 | A * | 11/1990 | Allen | 347/7 |
| 6,135,590 | A | 10/2000 | Saeki et al. | |
| 6,824,256 | B2 * | 11/2004 | Thielman et al. | 347/85 |
| 6,843,558 | B2 * | 1/2005 | Seino | 347/85 |
| 7,168,800 | B2 | 1/2007 | Katayama | |
| 7,434,462 | B2 * | 10/2008 | Usui et al. | 73/290 V |
| 7,568,793 | B2 * | 8/2009 | Lewey et al. | 347/85 |
| 8,015,866 | B2 * | 9/2011 | Aoki et al. | 73/149 |
| 8,221,698 | B2 * | 7/2012 | Aoki et al. | 422/403 |
| 8,434,859 | B2 * | 5/2013 | Karasawa et al. | 347/86 |
| 8,439,492 | B2 * | 5/2013 | Aoki et al. | 347/86 |
| 8,646,889 | B2 * | 2/2014 | Aoki et al. | 347/86 |
| 2005/0151813 | A1 * | 7/2005 | Ikezaki | 347/86 |
| 2007/0243104 | A1 * | 10/2007 | Aoki et al. | 422/58 |
| 2008/0148859 | A1 * | 6/2008 | Aoki et al. | 73/723 |
| 2008/0151018 | A1 * | 6/2008 | Aoki et al. | 347/86 |
| 2008/0198187 | A1 | 8/2008 | Aoki et al. | |
| 2008/0198211 | A1 * | 8/2008 | Aoki et al. | 347/86 |
| 2008/0252702 | A1 * | 10/2008 | Aoki et al. | 347/86 |
| 2009/0058907 | A1 | 3/2009 | Umeda | |
| 2009/0102880 | A1 | 4/2009 | Kimura | |
| 2009/0213159 | A1 | 8/2009 | Aoki et al. | |
| 2012/0147102 | A1 * | 6/2012 | Aoki et al. | 347/86 |

FOREIGN PATENT DOCUMENTS

| | | | |
|---|---|---|---|
| EP | 0626267 | A2 | 11/1994 |
| EP | 1348555 | A1 | 10/2003 |
| EP | 2208618 | A1 | 7/2010 |
| JP | 59-204570 | | 11/1984 |
| JP | 63-207652 | | 8/1988 |

(Continued)

*Primary Examiner* — Matthew Luu
*Assistant Examiner* — Lily Kemathe

(57) ABSTRACT

Part of a liquid chamber communicating with a liquid storage is formed of a deformable portion which is deformed. Part of a lever is brought into abutment with the deformable portion and, when the deformable portion is deformed, the lever is rotated about a supporting portion. The liquid storage, the liquid chamber, and the lever are stored in the interior of the case having a through hole, and when the liquid container is mounted on the liquid consuming apparatus, the movable rod on the side of the liquid consuming apparatus is inserted from the through hole and is brought into abutment with the lever.

8 Claims, 8 Drawing Sheets

(56) References Cited

FOREIGN PATENT DOCUMENTS

| | | |
|---|---|---|
| JP | 10-278293 | 10/1998 |
| JP | 2005-096428 | 4/2005 |
| JP | 2007-136807 | 6/2007 |
| JP | 2007-185933 | 7/2007 |
| JP | 2007-307894 | 11/2007 |
| JP | 2008-155596 | 7/2008 |
| JP | 2009-132134 | 6/2009 |
| WO | 2009066540 A1 | 5/2009 |

* cited by examiner

LIQUID CONTAINER AND LIQUID DETECTING SYSTEM

Priority is claimed under 35 U.S.C. §119 to Japanese Application No. 2011-130991 filed on Jun. 13, 2011 which is hereby incorporated by reference in its entirety.

BACKGROUND

1. Technical Field

The present invention relates to a liquid container configured to store liquid in the interior thereof, and a technology to detect presence and absence of liquid in the interior of the liquid container.

2. Related Art

Examples of known liquid consuming apparatus include so-called an ink jet printer configured to print an image or the like by ejecting liquid such as ink from an ejection head is known. The liquid ejected from the ejection head is stored in a specific liquid container such as an ink cartridge, and the liquid is supplied from the liquid container to the ejection head. The liquid container is generally configured to be demountably mounted with respect to a liquid consuming apparatus so as to be replaced with a new liquid container when the liquid in the interior is used up.

As the liquid container as described above, a configuration in which a detection system configured to detect the fact that the liquid in the interior is used up is proposed (for example, JP-A-2007-307894). The liquid container disclosed in JP-A-2007-307894 includes a piezoelectric detecting unit configured to detect vibrations which vary with the remaining amount of the liquid in a liquid detecting chamber communicating with the liquid storage portion. Since the detecting system is mounted on the liquid container itself, the fact that the liquid in the interior thereof is used up is immediately detected.

A variety of detecting systems configured to detect the fact that the liquid is used up are proposed. For example, a detecting system having a sub tank body formed partly of a deformable member and a sensor (photo sensor) configured to detect the displacement of the plate member which follows the deformation of the deformable member is proposed (JP-A-2007-136807). When the liquid is consumed and the interior of the sub tank is brought into a negative pressure, the deformable member is sucked into the sub tank. Therefore by detecting the displacement with the sensor, the fact that the liquid is used up can be detected simply with high degree of accuracy.

However, in the case of the configuration in which the piezoelectric detection unit configured to detect the vibrations which vary with the remaining amount of the liquid in the liquid detecting chamber communicating with the liquid storage portion as in JP-A-2007-307894, since the piezoelectric detecting unit is used, wiring for output a signal from the piezoelectric detecting unit is required, so that there arises a problem that the structure of the liquid container becomes complicated. In contrast, although the detecting system configured to detect the presence or absence of the liquid in the sub tank without using the above-described piezoelectric detecting unit is proposed in JP-A-2007-136807, a detailed configuration for a case of being mounted on the liquid container having a liquid detection chamber communicating with the liquid storage portion is not proposed.

SUMMARY

An advantage of some aspects in the invention is to provide a technology which enables detection of liquid in a liquid container with high degree of reliability with a simple configuration.

In order to solve at least part of the above described problem, the liquid container in the invention employs the following modes. That is, according to a first aspect in the invention, there is provided the liquid container mountable on a liquid consuming apparatus having a movable rod movable in an axial direction and a sensor configured to detect a displacement of the movable rod including: a liquid storage portion configured to store liquid; a liquid chamber provided so as to communicate with the liquid storage portion and partly formed with a deformable portion which is deformable; a lever member provided so as to be rotatable about a supporting point, configured to partly come into contact with the deformable portion and be displaceable in association with the deformation of the deformable portion; and a case member configured to store the liquid storage portion, the liquid chamber, and the lever member in the interior thereof, and having a through hole which allows insertion of the movable rod coming into abutment with the lever member.

With the liquid container in the invention as described above, the liquid chamber communicating with the liquid storage portion is provided, and part of the liquid chamber is formed of the deformable portion which is deformable. Part of the lever member is in contact with the deformable portion and, when the deformable portion is deformed, the lever member rotates about the supporting point. The liquid storage portion, the liquid chamber, and the lever member are stored in the interior of the case member having a through hole, and when the liquid container is mounted on the liquid consuming apparatus, the movable rod is inserted from the through hole and is brought into abutment with the lever member. In this manner, by storing the liquid storage portion, the liquid chamber, and the lever member in the interior of the case member, an erroneous detection (lowering of the accuracy of detection of the liquid) due to damages of the liquid chamber or the lever member relating to the liquid detection caused by deformation as a result of collision with a human or a substance may be inhibited and, as a result, detection of the liquid with high degree of reliability is achieved.

Preferably, an opening portion of the through hole on the side of the lever member is covered with the lever member in a state in which the liquid container is not mounted on the liquid consuming apparatus. In this configuration, since the lever member is capable of preventing entry of the foreign substances from the through hole, the probability of entry of the foreign substances in to the interior of the case member may be reduced. Consequently, lowering of the accuracy of the liquid detection caused by the foreign substances entered into the case member may be inhibited.

In the expression "the opening portion of the through hole on the side of the lever member is covered with the lever member", the lever member does not necessarily come into contact with the opening portion of the through hole, and even when a gap exists between the opening portion of the through hole and the lever member, entry of the foreign substances larger than the gap is prevented. Therefore, an effect of inhibiting the entry of the foreign substances into the interior of the case member is achieved. As a matter of course, if the lever member is in tight contact with the opening surface of the through hole, the opening surface is closed and hence the entry of the foreign substances from the through hole into the interior of the case member is avoided.

Preferably, the through hole of the case member is provided with a guiding portion configured to guide the movable rod by an inner wall surface when the movable rod is inserted. Accordingly, since the movable rod can be guided adequately, the positional displacement between the movable rod and the lever member is inhibited, and the reliability of the liquid detection may be enhanced.

When the lever member is provided at a position apart from the inner wall surface of the case member, the guiding portion may be formed of a tubular member. By extending the tubular member to a position of the lever member, the opening portion of the through hole can be covered with the lever member.

In the liquid container according to the invention described above, the following configuration is also applicable. First of all, a contact plane which is a plane including an abutting portion coming into abutment with the movable rod is formed on the lever member. Then, preferably, the opening surface of the through hole on the side of the lever member is provided in parallel to the contact plane of the lever member in a state in which the liquid container is not mounted on the liquid consuming apparatus.

When bringing the opening surface of the through hole on the side of the lever member into contact with the lever member in the state in which the liquid container is not mounted on the liquid consuming apparatus, the lever member may be brought into tight contact with the opening surface of the through hole by providing the opening surface of the through hole in parallel to the contact plane of the lever member. Accordingly, since the opening surface of the through hole is covered with the lever member without a gap, entry of the foreign substances from the through hole into the interior of the case member may be avoided.

In contrast, when not bringing the opening surface of the through hole on the side of the lever member into contact with the lever member in the state in which the liquid container is not mounted on the liquid consuming apparatus, the distance (gap) between the opening surface of the through hole and the contact plane of the lever member may be uniformized by arranging the opening surface of the through hole in parallel with the contact surface of the lever member. Therefore, in comparison with a case where there is a portion partly having a large gap between the opening surface of the through hole and the contact plane of the lever member, an effect of preventing entry of the foreign substances from the through hole may be enhanced.

Also, in the liquid container in the invention configured as described above, preferably, the opening surface of the through hole on the side of the lever member is provided so as to form a predetermined gap with respect to the lever member in a state in which the liquid container is not mounted on the liquid consuming apparatus.

In this manner, in the state in which the liquid container is not mounted on the liquid consuming apparatus, by providing the predetermined gap between the opening surface of the through hole on the side of the lever member and the lever member to avoid the contact of the lever member with respect to the opening surface of the through hole, even when the lever member in the interior moves reciprocally in association with the operation performed by a user of the liquid consuming apparatus shaking the liquid container (slightly rotated, and is returned back to a state before the rotation), the collision of the lever member with the opening surface of the through hole does not occur, and hence deformation or damage of the lever member due to the impact of collision is avoided.

Preferably, the lever member is urged by a resilient member toward the through hole.

Preferably, one of the opening surface of the through hole on the side of the lever member and the lever member is provided with a shock absorbing member at a portion coming into contact with the other.

In this configuration, the impact generated when the lever member comes into contact (collides) with the opening surface of the through hole on the side of the lever member is alleviated by the shock absorbing member. Therefore, even when the lever member in the interior moves reciprocally in association with the operation by the user of the liquid consuming apparatus shaking the liquid container, the deformation or damage of the lever member due to the impact is inhibited.

In the liquid container according to the invention described above, when the liquid container is mounted on the liquid consuming apparatus, the movable rod is inserted through the through hole of the case member, and the displacement of the deformable portion of the liquid chamber is detected by a sensor via the lever member and the movable rod, so that the presence or absence of the liquid in the interior is detected. Therefore, the invention may also be achieved in the mode of a liquid detecting system configured to detect the presence or absence of liquid in a liquid container mounted on a liquid consuming apparatus. Therefore, the liquid detecting system in the invention employs a configuration given below. That is, there is provided a liquid detecting system configured to detect the presence or absence of liquid in a liquid container mounted on a liquid consuming apparatus, wherein the liquid consuming apparatus includes: a movable rod movable in an axial direction; and a sensor configured to detect the displacement of the movable rod; the liquid container includes: a liquid storage portion configured to store liquid; a liquid chamber provided so as to communicate with the liquid storage portion and partly formed with a deformable portion which is deformable; a lever member provided so as to be rotatable about a supporting point, configured to partly come into contact with the deformable portion and be displaceable in association with the deformation of the deformable portion; and a case member configured to store the liquid storage portion, the liquid chamber, and the lever member in the interior thereof, and having a through hole which allows insertion of the movable rod coming into abutment with the lever member.

With the liquid detection system in the invention as described above, the liquid chamber communicating with the liquid storage portion of the liquid container is provided, and part of the liquid chamber is formed of the deformable portion which is deformable. Part of the lever member is in contact with the deformable portion and, when the deformable portion is deformed, the lever member rotates about the supporting point. The liquid storage portion, the liquid chamber, and the lever member are stored in the interior of the case member having a through hole, and when the liquid container is mounted on the liquid consuming apparatus, the movable rod is inserted from the through hole and is brought into abutment with the lever member.

With the liquid detection system in the invention configured in this manner, by storing the liquid storage portion, the liquid chamber, and the lever member in the interior of the case member, an erroneous detection (lowering of the accuracy of detection of the liquid) due to damages of the liquid chamber or the lever member relating to the liquid detection caused by deformation as a result of collision with a human or a substance may be inhibited and, as a result, detection of the liquid with high degree of reliability is achieved.

BRIEF DESCRIPTION OF THE DRAWINGS

The invention will be described with reference to the accompanying drawings wherein like numbers reference like elements.

DESCRIPTION OF EXEMPLARY EMBODIMENTS

In the following description, in order to clarify contents in the invention according to the present application described above, an embodiment will be described in the following order.

A. Configuration of Apparatus (First Embodiment):
  A-1. Configuration of Ink Jet Printer:
  A-2. Configuration of Ink Cartridge:
  A-3. Configuration of Rod and Sensor:
B. Detection of Presence or Absence of Ink in the Ink Cartridge (First Embodiment):
C. Countermeasure for Inhibition of Entry of Foreign Substance (First Embodiment):
D. Modifications:
  D-1. First Modification:
  D-2. Second Modification:

A. Configuration of Apparatus

A-1. Configuration of Ink Jet Printer

Figure 1:
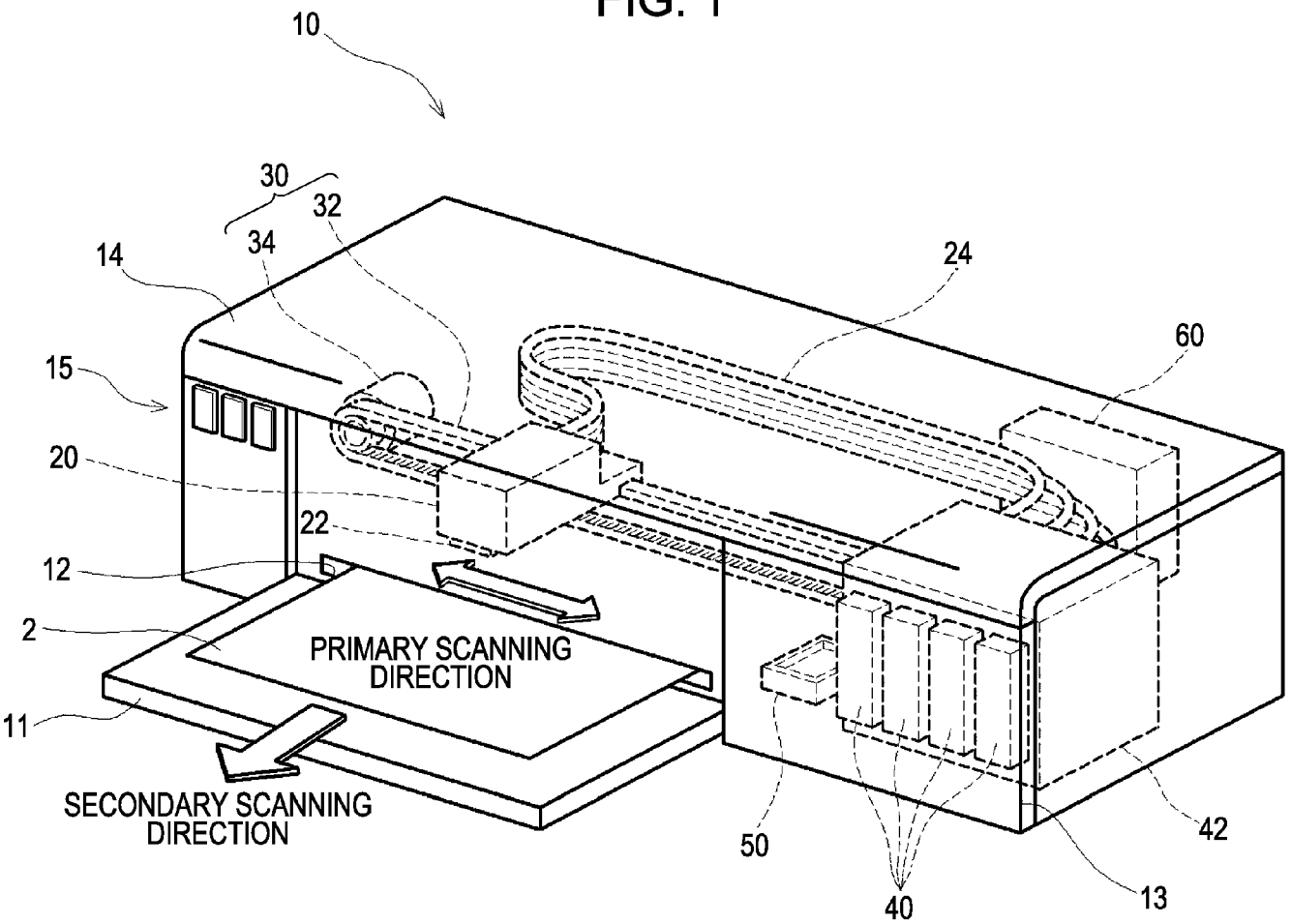
FIG. 1 is an explanatory drawing showing a rough configuration of a liquid consuming apparatus according to an embodiment while using so-called an inkjet printer as an example.

FIG. 1 is an explanatory drawing sowing a rough configuration of a liquid consuming apparatus according to an embodiment while exemplifying so-called an ink jet printer. An ink jet printer 10 shown in FIG. 1 has a substantially box shape in appearance, and includes a front cover 11 at a substantially center of the front surface thereof, and a plurality of operating buttons 15 are provided on the left side thereof. The front cover 11 is hinged on a lower end side thereof, and when an upper end side thereof is fallen toward the front, an elongated paper discharging port 12 which allows discharge of a printing sheet 2 as a printing medium appears. Also, a paper feed tray, not shown, is provided on the back side of the ink jet printer 10 and, when the printing sheet 2 is set on the paper feed tray and the operating buttons 15 are operated, the printing sheet 2 fed from the paper feed tray is fed by a predetermined amount in a secondary scanning direction, so that an image or the like is printed on the front surface of the printing sheet 2 in the interior thereof and then the printing sheet 2 is discharged from the paper discharging port 12.

Provided on the upper side of the ink jet printer 10 is an upper cover 14. The upper cover 14 is hinged on the inner side and, when the upper cover 14 is opened by lifting the front side thereof, confirmation of the state of the interior of the ink jet printer 10 or servicing the ink jet printer 10 are allowed.

Also, mounted in the interior of the ink jet printer 10 are a carriage 20 configured to form ink dots on the printing sheet 2 while moving reciprocally in the primary scanning direction and a driving mechanism 30 configured to move the carriage 20 reciprocally. Mounted on the bottom side of the carriage 20 (the side facing the printing sheet 2) is an ejecting head 22 formed with a plurality of ejection nozzles, and ink is ejected from the nozzles toward the printing sheet 2 to print images or the like. In the ink jet printer 10 in this embodiment, a color image may be printed using four colors of ink including cyan, magenta, yellow, and black, and, correspondingly, the ejecting head 22 mounted on the carriage 20 is provided with ejection nozzles for each of each ink types.

The ink to be ejected from the ejection nozzle formed on the ejecting head 22 is accommodated in specific containers referred to as an ink cartridge 40. The ink cartridges 40 are configured to be mountable and demountable with respect to the cartridge holder 42 provided on a different position from the carriage 20. When the ink cartridges 40 are mounted on the cartridge holder 42, the ink in the ink cartridges 40 is supplied to the ejecting head 22 of the carriage 20 via the cartridge holder 42 and ink tubes 24. In the ink jet printer 10 in this embodiment, a cartridge replacement cover 13 hinged on the lower end side in the same manner as the front cover 11 is provided on the right side of the front cover 11, and when an upper end side of the cartridge replacement cover 13 toward the front, the cartridge holder 42 appears to allow demounting and mounting of the ink cartridges 40. A state of mounting the ink cartridges 40 on the cartridge holder 42 and a detailed configuration of the ink cartridge 40 will be described later with different drawings.

As described above, since the ink jet printer 10 of this embodiment uses the four types of ink including cyan, magenta, yellow, and black, the ink cartridge 40 is provided for each of the ink types. Ink in each of the ink cartridges 40 is supplied to the ejection nozzles for the corresponding color on the ejecting head 22 via the ink tube 24 provided for each of the ink types.

The driving mechanism 30 which causes the carriage 20 to reciprocate includes a timing belt 32 formed with a plurality of teeth inside thereof, and a driving motor 34 configured to drive the timing belt 32. Part of the timing belt 32 is fixed to the carriage 20. When the timing belt 32 is driven, the timing belt 32 causes the carriage 20 to reciprocate in the primary scanning direction while guiding the carriage 20 by a guide rail, not shown, extending in the primary scanning direction.

There is provided an area referred to as "home position" at a position out of a printing area where the carriage 20 is moved in the primary scanning direction, and a maintenance mechanism configured to perform maintenance so as to achieve a normal printing operation is mounted at the home position. The maintenance mechanism includes a cap member 50 configured to form a closed space so as to cover the ejection nozzles by being pressed against the bottom surface side (the side facing the printing sheet 2) of the ejection head 22, an elevating mechanism (not shown) to move the cap member 50 upward and downward for pushing the cap member 50 against the bottom surface side of the ejection head 22, and a suction pump, not shown, configured to introduce a negative pressure into the cap member 50 in a state of being pressed against the bottom surface side of the ejection head 22.

In the interior of the ink jet printer 10, a paper feeding mechanism, not shown, for feeding printing sheet 2 in the secondary scanning direction and a control unit 60 configured to control the operation of the entire ink jet printer 10 are mounted. The operation to cause the carriage 20 to reciprocate, the operation to feed the printing sheet 2, the operation to eject ink from the ejection nozzle, the operation to execute the maintenance to achieve normal printing, and so on are all controlled by the control unit 60.

Figure 2:
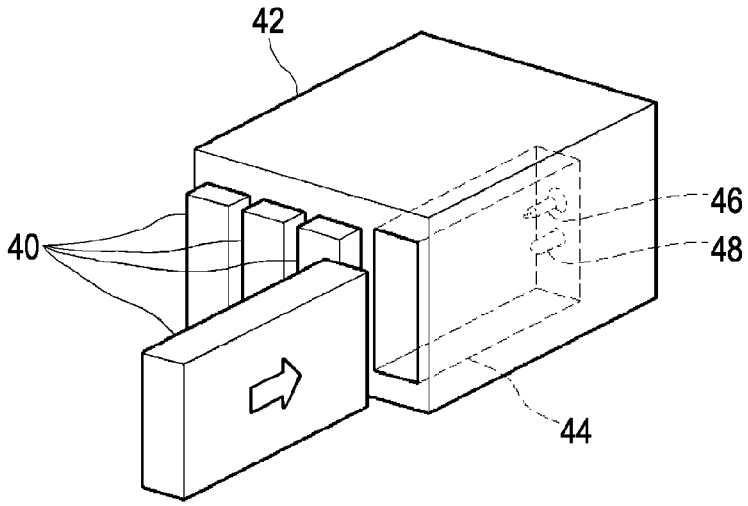
FIG. 2 is an explanatory drawing showing a state of mounting an ink cartridge in a cartridge holder.

FIG. 2 is an explanatory drawing showing a state of mounting the ink cartridges 40 in the cartridge holder 42. As illustrated, the cartridge holder 42 is formed with insertion holes 44 for allowing insertion of each of the ink cartridges 40 from the near side to the inner side. On the inner surface of each of the insertion holes 44 is formed with an ink introducing needle 46 for introducing ink from the ink cartridge 40 so as to extend toward the near side. Also, on the back surface of the ink cartridge 40 (the surface facing the inner side of the insertion hole 44) is formed with an ink supply port, not shown. When the ink cartridge 40 is inserted into the insertion hole 44 of the cartridge holder 42 to the inner side thereof, the ink introducing needle 46 is inserted into the ink supply port, and ink in the ink cartridge 40 may be taken into the cartridge holder 42.

The cartridge holder 42 is provided with ink channels and supply pumps, not shown, integrated therein. The ink introduced from the ink introducing needles 46 are guided to ink tubes 24 (see FIG. 1) connected to the back side of the cartridge holder 42 by the ink channel. The supply pump (for example, a diaphragm pump) provided at a midsection of the ink channel is configured to suck ink in the ink cartridges 40 and pump the ink toward a sub tank, not shown, provided in the carriage 20. As described above, the ink cartridges 40 for the four colors of cyan, magenta, yellow, and black are mounted on the ink jet printer 10 in this embodiment, and inks in the respective ink cartridges 40 are supplied independently to the ejection head 22. Therefore, the ink channel or the supply pump is provided for each of the ink cartridges 40 in the interior of the cartridge holder 42.

The insertion hole 44 of the cartridge holder 42 includes a bar-shaped rod 48 projecting from the surface on the inner side surface toward the near side. Although detailed description will be given later, the cartridge holder 42 is provided with sensors for detecting the presence or absence of ink in the ink cartridges 40, and the rods 48 serve to transmit the states in the ink cartridges (presence or absence of ink) to the sensors. The configurations of the rod 48 and the sensor will be described after the description of the configuration of the ink cartridge 40.

Figure 3:
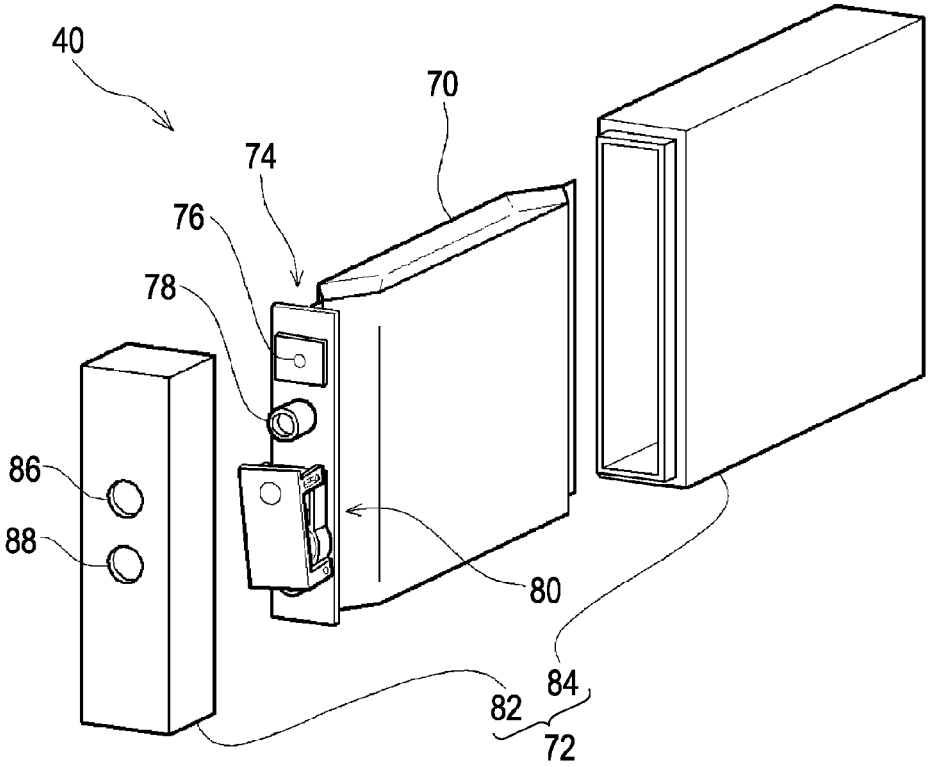
FIG. 3 is an exploded perspective view showing a configuration of ink cartridge of the embodiment.

A-2. Configuration of Ink Cartridge:

FIG. 3 is an exploded perspective view showing a configuration of the ink cartridge 40 of the embodiment. As illustrated, the ink cartridge 40 includes an ink pack 70 configured to store ink therein, and a cartridge case 72 configured to accommodate the ink pack 70. The ink pack 70 is formed by sticking films which does not allow liquid such as ink to pass through into a bag shape and closing the opening in a state in which an ink supply unit 74 is tucked in the opening of the bag. For reference, the ink cartridge 40 in this embodiment corresponds to a "liquid container" in the invention, and the ink pack 70 in this embodiment corresponds to a "liquid storage portion" in the invention.

The ink supply unit 74 is provided with an ink filling port 76 for injecting ink in the ink pack 70 in a manufacturing state of the ink cartridge 40, an ink supply port 78 which allows insertion of the ink introducing needle 46 on the side of the cartridge holder 42 described above, and an ink detecting mechanism 80 configured to detect the presence or absence of the ink in the ink pack 70. Detailed configuration of the ink detecting mechanism 80 will be described later.

The cartridge case 72 configured to accommodate the ink pack 70 includes a front case 82 and a rear case 84. The rear case 84 is formed into a box shape and allows the ink pack 70 to be accommodated therein. In contrast, the front case 82 is a member for covering the ink supply unit 74 and covering the rear case 84 by fitting thereto. The front case 82 is provided with an introducing needle through hole 86 configured to receive the ink introducing needle 46 on the side of the cartridge holder 42 and a rod through hole 88 configured to receive the rod 48 when the ink cartridge 40 is mounted on the cartridge holder 42. The cartridge case 72 corresponds to a "case member" in the invention.

Figure 4:
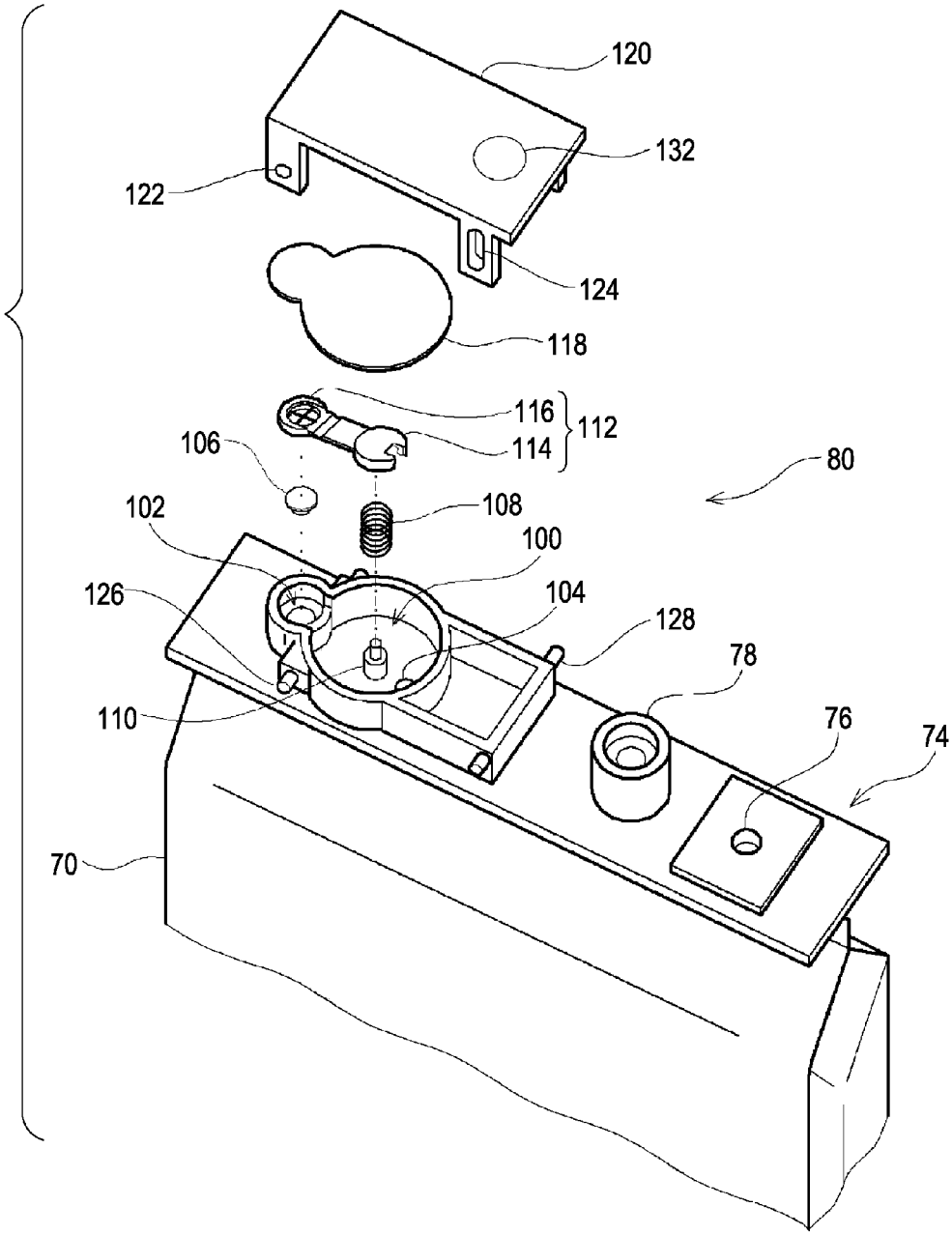
FIG. 4 is an exploded perspective view showing a configuration of an ink detecting mechanism mounted on the ink cartridge according to the embodiment.

FIG. 4 is an exploded perspective view showing a configuration of the ink detecting mechanism 80 integrated in the ink cartridge 40 according to the embodiment. FIG. 4 shows a state in which the ink supply port 78 of the ink supply unit 74 is oriented upward. As illustrated, the ink detecting mechanism 80 is provided with a substantially cylindrical shaped liquid chamber 100. The liquid chamber 100 is formed with an inflow port 102 for allowing the ink in the ink pack 70 to flow in and an outflow port 104 configured to allow the ink to flow out toward the ink supply port 78. Also, an end surface (an upper end surface in the drawing) of the liquid chamber 100 is formed of a film 118 of a flexible material.

In the interior of the liquid chamber 100 is provided with a check valve 106 which prevents the ink flowed into the liquid chamber 100 from the inflow port 102 from flowing in the reverse direction and a urging spring 108 configured to urge the film 118 toward the outside of the liquid chamber 100. The urging spring 108 is positioned by being fitted on the projection 110 provided so as to stand upward from the bottom surface of the liquid chamber 100, and is provided in a compressed state. Inserted between the urging spring 108 and the film 118 is a pressure receiving panel 112. The pressure receiving panel 112 integrally includes a pressure receiving portion 114 configured to transmit the urging force of the urging spring 108 to the film 118 and a limiting portion 116 configured to limit the movement of the check valve 106 so as to be coupled to each other. When the limiting portion 116 of the pressure receiving panel 112 is fixed to a position in an upper portion of the inflow port 102, the movement of the check valve 106 is limited between the inflow port and the limiting portion 116, and the pressure receiving portion 114 is positioned in a state of being clamped between the urging spring 108 and the film 118. In this embodiment, although the pressure receiving portion 114 and the limiting portion 116 are integrally configured, the pressure receiving portion 114 and the limiting portion 116 may be configured separately.

Provided above the liquid chamber 100 is a lever member 120 configured to come into contact with the film 118 which constitutes the upper end surface of the liquid chamber 100 from the outside of the liquid chamber 100. Here, the expression "the lever member 120 comes into contact with the film 118 of the liquid chamber 100" is not limited to the case where the lever member 120 is in contact with the film 118 so as to come into and out of contact, and also includes a case where the lever member 120 and the film 118 are adhered to each other with an adhesive agent or the like so as not come apart. The lever member 120 includes a shaft hole 122 at one end thereof, and is rotatably supported by fitting a shaft pin 126 provided on the outside surface of the liquid chamber 100 into the shaft hole 122. In contrast, a guide hole 124 is provided on the other end of the lever member 120, and the rotary motion of the lever member 120 is guided by inserting the guide pin 128 fixed to the ink supply unit 74 into the guide hole 124. Furthermore, provided on an upper surface of the lever member 120 (on the surface opposite from the side facing the film 118) is an abutting portion 132 where a distal end of the rod 48 on the side of the cartridge holder 42 comes into abutment with the abutting portion 132. In a state in which the ink cartridge 40 is not mounted on the ink jet printer 10, the lever member 120 is urged toward the front case 82 by the urging spring 108 provided in the liquid chamber 100. Accordingly, although described later in detail, the opening surface of the rod through hole 88 provided on the front case 82 on the side of the lever member 120 is covered with the lever member 120. In the ink cartridge 40 having the ink detecting mechanism 80 in this configuration, the ink in the ink pack 70 is supplied to the cartridge holder 42 in the following manner.

Figure 5A:
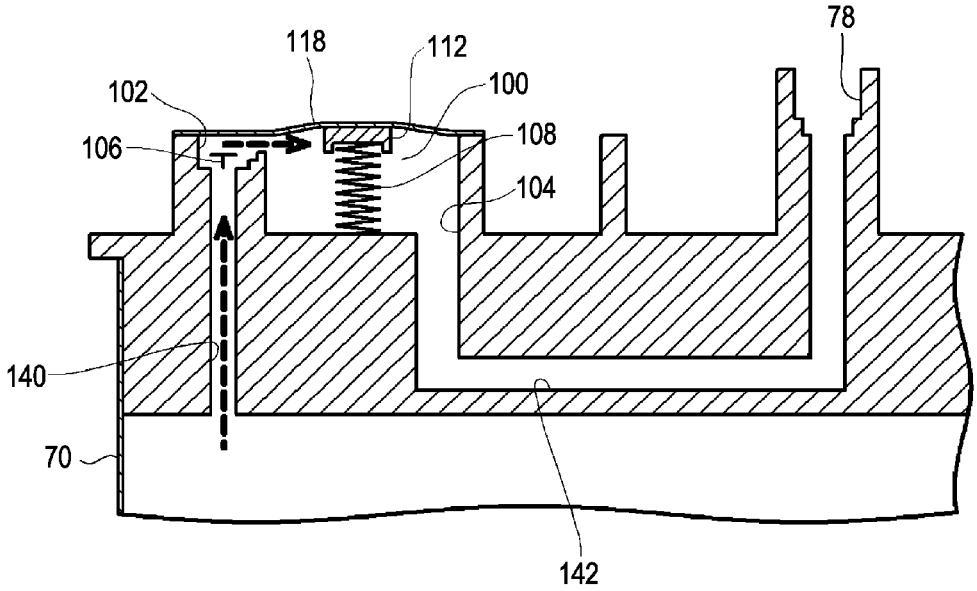
FIGS. 5A and 5B are cross-sectional views showing a state in which ink in the ink pack is supplied to the cartridge holder.
Figure 5B:
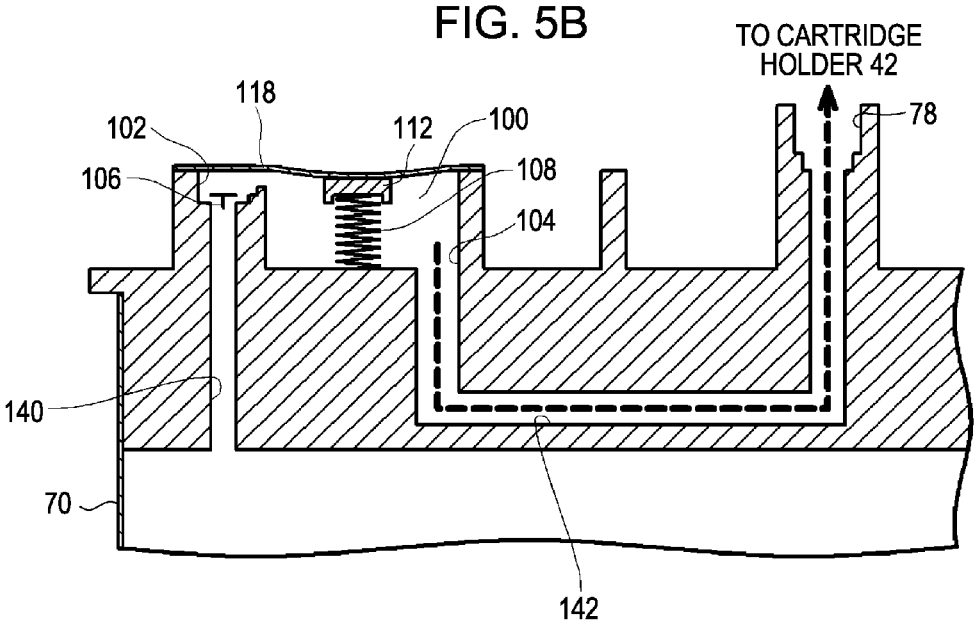

FIGS. 5A and 5B are explanatory drawings showing a state in which the ink in the ink pack 70 is supplied to the cartridge holder 42 by taking a section of the ink supply unit 74. In FIGS. 5A and 5B, in order to avoid the illustration from becoming complex, illustration of the lever member 120 and the limiting portion 116 of the pressure receiving panel 112 is omitted. As described above, the supply pump, not shown, is integrated in the cartridge holder 42, so as to suck the ink in the ink cartridge 40 and pumped toward the carriage 20. FIG. 5A shows a state in which the supply pump of the cartridge holder 42 is not in operation, and FIG. 5B shows a state in which the supply pump of the cartridge holder 42 is in operation.

As described above, the urging spring 108 is provided in the liquid chamber 100, and the urging spring 108 urges the film 118 to the outside of the liquid chamber 100. Therefore, as shown in FIG. 5A, in a state in which the supply pump of the cartridge holder 42 is not in operation, the film 118 assumes a state of projecting toward the outside of the liquid chamber 100 by being pushed out by the urging spring 108. At this time, even when the capacity of the liquid chamber 100 is increased, since the ink in the ink pack 70 flows into the liquid chamber 100 through the inflow channel 140 connecting the ink pack 70 and the inflow port 102 as indicated by an arrow in a thick broken line in the drawing, the interior of the liquid chamber 100 is not brought into a negative pressure. As described above, the inflow port 102 is provided with the check valve 106, so that the reverse flow of the ink from the liquid chamber 100 is prevented, but the ink is allowed to flow into the liquid chamber 100.

Subsequently, when the supply pump of the cartridge holder 42 is operated, the ink is sucked from the ink supply port 78 and the ink in the liquid chamber 100 is supplied to the cartridge holder 42 through the outflow channel 142 which connects the outflow port 104 and the ink supply port 78. Then, in the ink cartridge 40 of this embodiment, the inner diameter of the outflow channel 142 is set to be larger than the inner diameter of the inflow channel 140. Therefore, when inflow of the ink to the liquid chamber 100 cannot keep up with outflow of the ink from the liquid chamber 100, the interior of the liquid chamber 100 is brought into a negative pressure. Consequently, as shown in FIG. 5B, the film 118 is deformed so as to be sucked into the liquid chamber 100 against the force of the urging spring 108.

When the supply pump of the cartridge holder 42 is stopped, the negative pressure generated in the liquid chamber 100 is gradually cancelled by the ink in the ink pack 70 flowing into the liquid chamber 100 through the inflow channel 140. Then, since the film 118 is pushed out of the liquid chamber 100 again by a force of the urging spring 108, the film 118 is restored to a state shown in FIG. 5A after a predetermined time has elapsed from the stop of the supply pump of the cartridge holder 42.

While the ink in the ink pack 70 is supplied to the cartridge holder 42 via the liquid chamber 100 in this manner, the ink pack 70 is gradually deflated (reduced in capacity). Then, when the ink in the ink pack 70 is used up (reduced to an amount smaller than a predetermined amount), the ink is not supplied to the liquid chamber 100 any longer even when there is a negative pressure in the liquid chamber 100. Therefore, even after the predetermined time has elapsed from the stop of the supply pump of the cartridge holder 42, the negative pressure in the liquid chamber 100 is not cancelled, and the film 118 remains sucked into the liquid chamber 100 as shown in FIG. 5B.

In this manner, in the ink cartridge 40 in this embodiment, when the ink in the ink pack 70 is used up (reduced to an amount smaller than the predetermined amount), the film 118 which constitutes the one end surface of the liquid chamber 100 remains deformed so as to be sucked into the liquid chamber 100, so that the fact that the ink in the ink pack 70 is used up can be detected by detecting the displacement of the film 118. However, in the ink cartridge 40 in this embodiment, since the displacement of the film 118 is small, the displacement is amplified by using the lever member 120 as described below.

Figure 6:
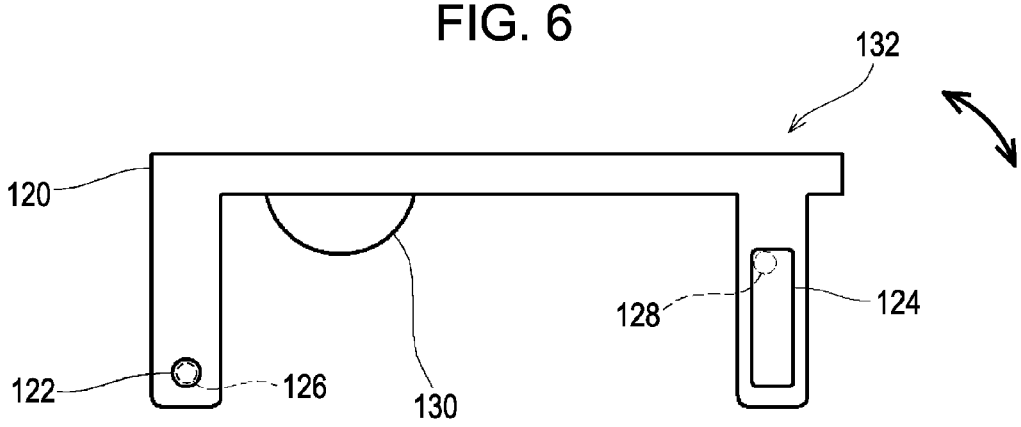
FIG. 6 is an explanatory drawing showing a configuration of a lever member provided on the ink cartridge according to the embodiment.

FIG. 6 is an explanatory drawing showing the configuration of the lever member 120 integrated in the ink cartridge 40 according to the embodiment. As illustrated, the shaft hole 122 is provided at one end of the lever member 120, and by fitting a shaft pin 126 provided on the outer surface of the liquid chamber 100 (see FIG. 4) to the shaft hole 122, the lever member 120 is configured to be rotatable about the shaft hole 122. Also, a guide hole 124 is provided on the other end of the lever member 120, and the guide pin 128 (see FIG. 4) fixed to the ink supply unit 74 is inserted through the guide hole 124. When the lever member 120 rotates, the guide pin 128 moves along the guide hole 124, so that the rotary motion of the lever member 120 is guided. Therefore, the rotation (displacement) of the lever member 120 can be controlled with high degree of accuracy.

Provided on a surface of the lever member 120 opposing the film 118 is a semi-spherical shaped projection 130 coming into contact with the film 118, and provided on the surface of the lever member 120 on the side opposite from the side opposing the film 118 is the abutting portion 132 with which the distal end of the rod 48 provided on the side of the cartridge holder 42 comes into abutment. Then, since the distance from the shaft hole 122 which corresponds to the supporting point of the lever member 120 to the abutting portion 132 is set to be larger than the distance from the shaft hole 122 to the projecting portion 130, when the film 118 coming into contact with the projecting portion 130 is deformed, the deformation is amplified and is transmitted to the abutting portion 132. The displacement of the film 118 amplified by the lever member 120 is transmitted to the sensor in the cartridge holder 42 via the rod 48 which comes into abutment with the abutting portion 132 of the lever member 120. The projecting portion 130 in this embodiment corresponds to a "first contact point" in the invention, and the abutting portion 132 in the embodiment corresponds to a "second contact point" in the invention.

Figure 7:
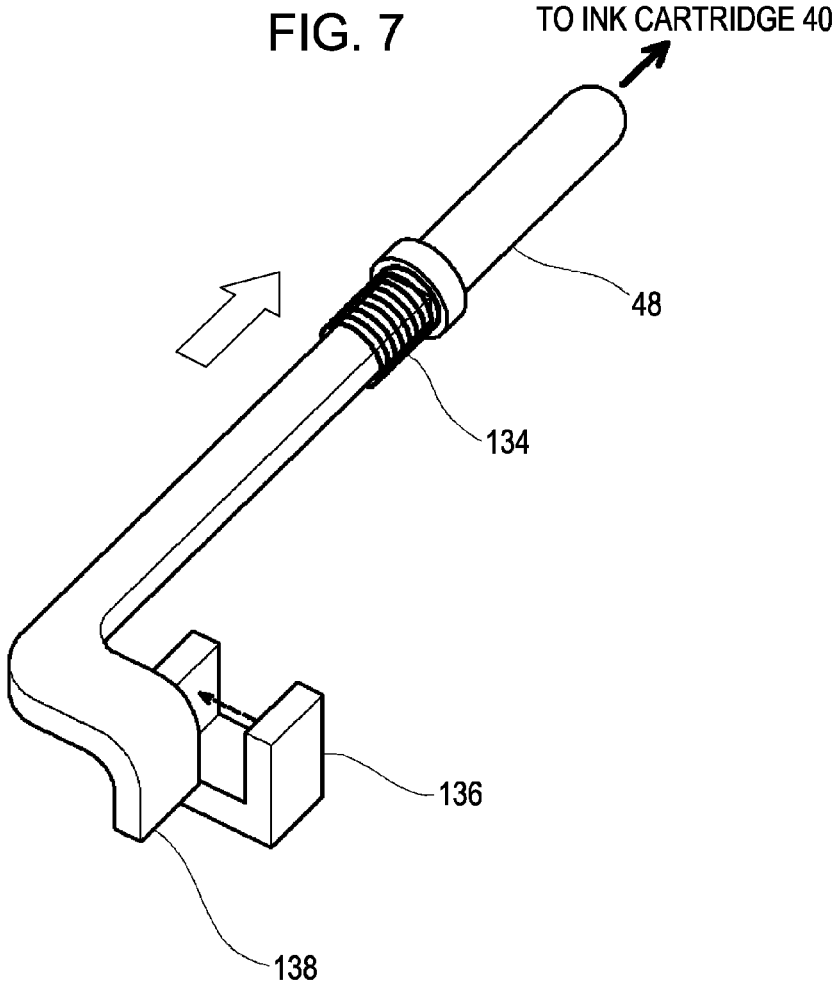
FIG. 7 is a perspective view showing a configuration of a rod and a sensor provided on the cartridge holder according to the embodiment.

A-3. Configuration of Rod and Sensor:

FIG. 7 is a perspective view showing a configuration of a rod 48 and a sensor 136 provided on the cartridge holder 42 according to the embodiment. For reference, FIG. 7 shows a state of the rod 48 and the sensor 136 viewed from the inner side of the cartridge holder 42 shown in FIG. 2. The rod 48 is a bar-shaped member provided so as to be movable in the axial direction, and the urging spring 134 is attached to a center portion thereof. The urging spring 134 urges the rod 48 toward the ink cartridge 40 to be mounted on the cartridge holder 42 (in the direction indicated by a hollow arrow in the drawing). The rod 48 in this embodiment corresponds to a "movable rod" in the invention.

So-called a transmissive photo sensor having an angular U-shape in cross-section is used as the sensor 136 in this embodiment. The sensor 136 is provided with a light-emitting element and a light-receiving element, not shown, so as to oppose each other, and light emitted from the light-emitting element is received by the light-receiving element. The arrow in a broken line in the drawing indicates the direction of transmission of the light from the light-emitting element to the light-receiving element.

The light-blocking portion 138 is provided at an end portion of the rod 48 on the opposite side from the ink cartridge 40. When the rod 48 is moved toward the ink cartridge 40 side by a force of the urging spring 134, the light-blocking portion 138 is inserted between the light-emitting element and the light-receiving element of the sensor 136 and blocks the light from the light-emitting element. Consequently, since the light-receiving element of the sensor 136 cannot receive the light from the light-emitting element, the fact that the position of the rod 48 is changed can be detected. Although the transmissive photo sensor is used for the sensor 136 in this embodiment, the sensor 136 may be of any type as long as the displacement of the rod 48 can be detected, and is not limited to the photo sensor.

Figure 8A:
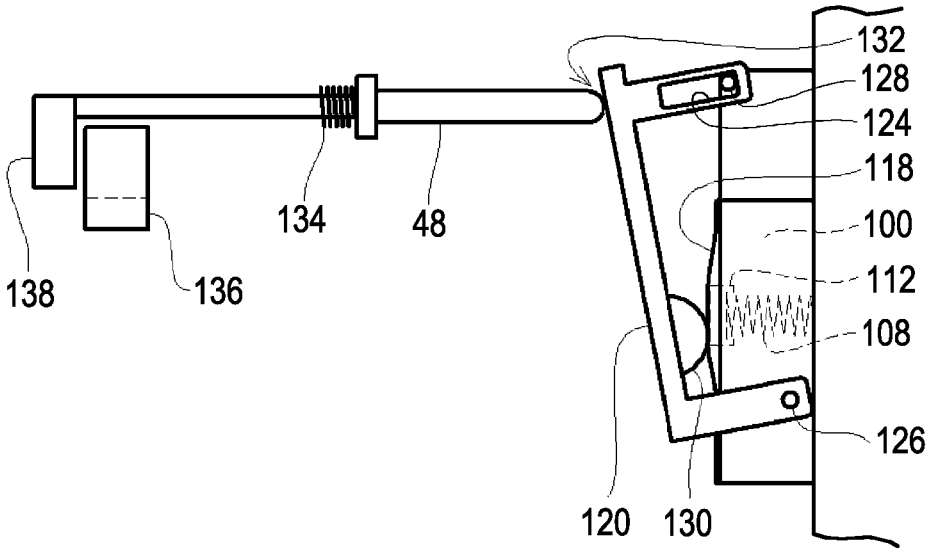
FIGS. 8A and 8B are explanatory drawings showing a state of detecting the presence or absence of ink in the ink cartridge with a sensor integrated in the cartridge holder.
Figure 8B:
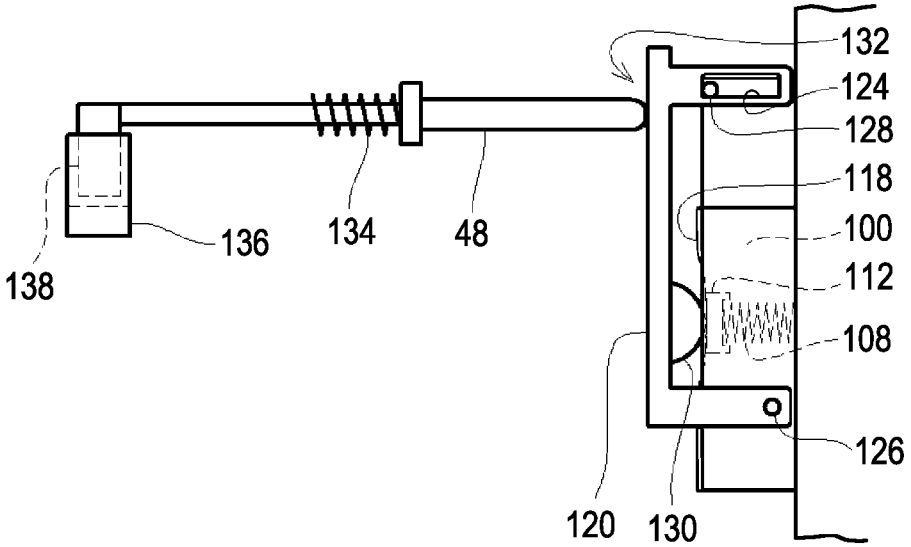

B. Detection of Presence or Absence of Ink in the Ink Cartridge:

FIGS. 8A and 8B are explanatory drawings showing a state of detecting the presence or absence of ink in the ink cartridge 40 with a sensor 136 integrated in the cartridge holder 42. Although a state in which the ink cartridge 40 is mounted on the cartridge holder 42 is shown, in order to avoid the illustration from becoming complex, illustration of the cartridge case 72 and the cartridge holder 42 is omitted.

First of all, FIG. 8A shows a state in which the ink is present in the ink pack 70 of the ink cartridge 40 (at least a predetermined mount of ink is remained). As described above using FIGS. 5A and 5B, if the ink is present in the ink pack 70, the film 118 which constitutes one end surface of the liquid chamber 100 is pushed out by the urging spring 108 in the liquid chamber 100, and is projected outward of the liquid chamber 100. In order to do so, the lever member 120 which comes into contact with the film 118 with the projecting portion 130 is in the state of being inclined so as to be apart from the liquid chamber 100 (hereinafter, this state is referred to as "opened state"). In the state in which the ink cartridge 40 is not mounted on the ink jet printer 10, the lever member 120 is in the opened state in the same manner.

When the ink cartridge 40 is mounted on the cartridge holder 42, the abutting portion 132 of the lever member 120 comes into abutment with the distal end of the rod 48. As described above, the rod 48 is urged toward the ink cartridge 40 by the urging spring 134, when the abutting portion 132 of the lever member 120 comes into abutment, the rod 48 is moved toward the inner side of the cartridge holder 42 (the side opposite from the ink cartridge 40) against the urging force of the abutting portion 132. Consequently, as shown in FIG. 8A, the light-blocking portion 138 of the rod 48 moves away from the sensor 136, and light passes through the sensor 136. The urging force of the urging spring 108 on the side of the liquid chamber 100 is set to be sufficiently large in comparison with the urging force of the urging spring 134 on the side of the rod 48, the film 118 of the liquid chamber 100 is not deformed by the abutment of the lever member 120 with the rod 48.

In contrast, FIG. 8B shows a state in which the ink in the ink pack 70 is used up (reduced to an amount smaller than the predetermined amount). As described above, when the ink in the ink pack 70 is used up and hence the ink is not supplied to the liquid chamber 100 any longer, a negative pressure is accumulated in the liquid chamber 100, the film 118 remains sucked into the liquid chamber 100 against the urging force of the urging spring 108.

When the film 118 is sucked into the liquid chamber 100 in this manner, the rod 48 which has been pressed against the abutting portion 132 by the urging force of the urging spring 134 causes the lever member 120 to rotate in association with the deformation of the film 118. Consequently, the lever member 120 is brought into a state of snuggling up to the liquid chamber 100 (hereinafter, this state is referred to as "closed state"). Also, in association with the rotation of the lever member 120, the rod 48 moves toward the ink cartridge 40. Then, the light-blocking portion 138 of the rod 48 is inserted between the light-emitting element and the light-receiving element of the 136, so that the light cannot pass through the sensor 136.

In this manner, the light pass through the sensor 136 when the ink is present in the ink pack 70, while the light cannot pass through the sensor 136 when the ink in the ink pack 70 is used up. As described above, the entire operation of the ink jet printer 10 is controlled by the control unit 60, and the control unit 60 receives an input of a signal which indicates the presence or absence of the passage of the light from the sensor 136. Therefore, the control unit 60 is capable of detecting the presence or absence of the ink in the ink pack 70 on the basis of the signal from the sensor 136, displays a prompt to encourage a user to replace the ink cartridge 40 with a new ink cartridge 40 on a display panel, not shown. As described above, the negative pressure in the liquid chamber 100 may not cancelled and the film 118 may be sucked into the liquid chamber 100 even when the ink remains in the ink pack 70 until the predetermined time is elapsed from the stop of the supply pump of the cartridge holder 42. Therefore, the sensor 136 detects whether or not the light passes therethrough after the predetermined time has elapsed from the stop of the supply pump.

Here, as described above, the liquid chamber 100 and the lever member 120 of the configuration for detecting the presence or absence of the ink in the ink pack is accommodated in the front case 82 and is provided in the ink cartridge 40, and the rod 48 and the sensor 136 are provided in the cartridge holder 42 on the side of the ink jet printer 10. Then, when the ink cartridge 40 is mounted on the cartridge holder 42, the displacement of the liquid chamber 100 is transmitted to the sensor 136 by the abutment of the lever member 120 with the distal end of the rod 48. Because of the employment of such a system, the cartridge case 72 which forms an outer shell of the ink cartridge 40 needs to be provided with a through hole (the rod through hole 88) for receiving the rod 48. However, if there is the rod through hole 88 on the cartridge case 72, foreign substances such as paper strips may enter from the rod through hole 88 in a state in which the ink cartridge 40 is not mounted on the cartridge holder 42. In particular, in the case of the ink containing a component which is subjected to sedimentation, a state in which the ink cartridge 40 is removed from the cartridge holder 42 in order to shake the ink cartridge 40 and mix the ink in the interior thereof occurs from time to time, the probability of entry of the foreign substances into the cartridge case 72 increases. Then, when the foreign substances enters the cartridge case 72, the rotary motion of the lever member 120 may be disturbed by the foreign substance, whereby the presence or absence of the ink in the ink pack 70 may not be detected accurately. Accordingly, the ink cartridge 40 in this embodiment employs a configuration as described below in order to inhibit the foreign substances from entering the cartridge case 72 from the rod through hole 88.

Figure 9:
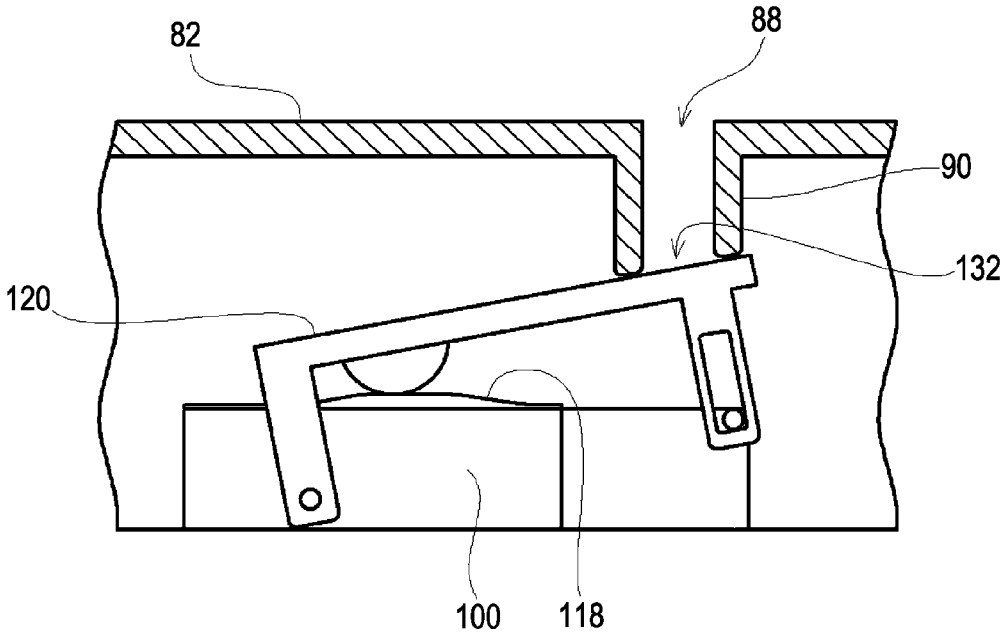
FIG. 9 is an explanatory drawing showing a positional relationship between a rod through hole and a lever member by taking a section of the front case.

C. Countermeasure for Inhibition of Entry of Foreign Substance:

FIG. 9 is an explanatory drawing showing a positional relationship between the rod through hole 88 and the lever member 120 by taking a section of the front case 82. In FIG. 9, a state in which the ink is present in the ink pack 70, and the lever member 120 is in the opened state. As illustrated, the front case 82 of the cartridge case 72 is provided with the rod through hole 88 for allowing passage of the rod 48 at a position corresponding to the abutting portion 132 of the lever member 120 accommodated therein. The rod through hole 88 is provided with a tubular guiding portion 90 so as to extend toward the inside of the cartridge case 72. When the rod 48 is inserted into the rod through hole 88, the direction of insertion of the rod 48 is guided correctly by the inner wall surface of the guiding portion 90, and hence the distal end of the rod 48 can be brought into adequate abutment with the abutting portion 132 of the lever member 120.

Then, in the ink cartridge 40 in this embodiment, the rod through hole 88 extends to a position (depth) of the lever member 120 in the opened state, when the lever member 120 is in the opened state (when the ink is present in the ink pack 70), the opened surface on the side of the lever member 120 of the rod through hole 88 is covered with the lever member 120.

Also, in the state in which the lever member 120 is opened, the opening surface of the rod through hole 88 on the side of the lever member 120 is provided in parallel with the surface of the lever member 120 where the abutting portion 132 is provided (the contact plane). Therefore, the contact plane of the lever member 120 may be brought into tight contact with the opening surface of the rod through hole 88 on the side of the lever member 120 without gap.

As described above, in the ink cartridge 40 in this embodiment, the cartridge case 72 is provided with the rod through hole 88 configured to receive the rod 48 and brings the rod 48 into abutment with the lever member 120, and the opening surface of the rod through hole 88 on the side of the lever member 120 is covered with the lever member 120 in the opened state. Accordingly, even when the foreign substances make an attempt to enter from the rod through hole 88, the lever member 120 which covers the opening surface of the rod through hole 88 prevents the foreign substances from entering further inward, so that the probability of entry of the foreign substances into the cartridge case 72 may be reduced. Consequently, such an event that the presence or absence of the ink in the ink pack 70 cannot be detected due to the foreign substances entered into the cartridge case 72 can be restrained.

In particular, in the ink cartridge 40 in this embodiment, the opening surface of the rod through hole 88 on the side of the lever member 120 is provided in parallel with the contact plane of the lever member 120 in the opened state to cause the contact plane of the lever member 120 into tight contact with the opening surface of the rod through hole 88. Accordingly, the gap between the opening surface of the rod through hole 88 and the lever member 120 can be eliminated, and the entry of the foreign substances from the rod through hole 88 into the cartridge case 72 can be prevented.

Also, since the opening surface of the rod through hole 88 is covered by using the lever member 120 for amplifying the displacement of the film 118 of the liquid chamber 100, it is not necessary to add a new member for preventing the entry of the foreign substances from the rod through hole 88 (for example, a film or a lid member for covering the rod through hole 88), and reduction of the probability of the entry of the foreign substances from the rod through hole 88 is easily achieved.

In addition, since the lever member 120 resides in side the cartridge case 72 by an extent corresponding to the depth of the guiding portion 90, the user of the ink jet printer 10 can hardly touch the lever member 120 from the rod through hole 88 when handling the ink cartridge 40 (shaking the ink cartridge 40 for mixing the ink, for example). Consequently, application of an impact or adhesion of stain to the lever member 120 may be inhibited.

D. Modifications:

In the ink cartridge 40 of this embodiment described above, several modifications exist. These modifications will be described below. Therefore. In the description of the modifications, the same components as the above-described embodiment are denoted by the same reference numerals as described above, and detailed description of the common portions will be omitted.

D-1. First Modification:

In the embodiment described above, the contact plane of the lever member 120 is in tight contact with the opening surface of the rod through hole 88 in a state in which the lever member 120 is opened. However, the opening surface of the rod through hole 88 and the contact plane of the lever member 120 do not necessarily have to be in contact with each other, and a predetermined gap may be provided between the opening surface of the rod through hole 88 and the contact plane of the lever member 120.

Figure 10:
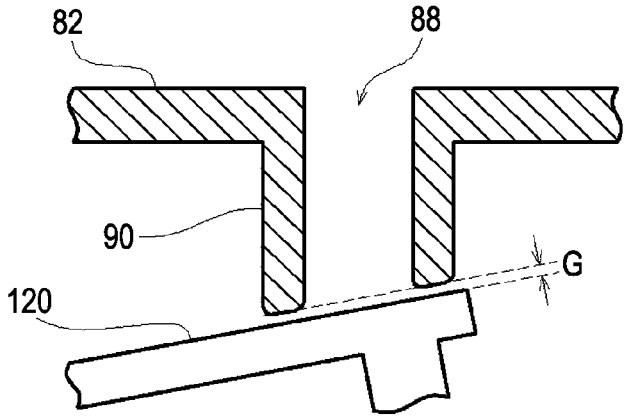
FIG. 10 is an enlarged explanatory drawing of the ink cartridge according to a first modification, showing a portion in the periphery of an opening surface of the rod through hole on the side of the lever member by taking an section of the front case.

FIG. 10 is an enlarged explanatory drawing of the ink cartridge 40 according to a modification, showing a portion in the periphery of an opening surface of the rod through hole 88 on the side of the lever member 120 by taking an section of the front case 82. In FIG. 10, the lever member 120 in the opened state is shown. As illustrated, in the ink cartridge 40 in the first modification, the guiding portion 90 is provided on the rod through hole 88 in the same manner as the above-described embodiment (see FIG. 9). However, a predetermined gap G (0.5 mm, for example) is provided between the opening surface of the rod through hole 88 on the side of the lever member 120 and the contact plane of the lever member 120 in the opened state, so that the mutual contact is avoided.

In this manner, even when the gap G is provided between the opening surface of the rod through hole 88 on the side of the lever member 120 and the contact plane of the lever member 120 in the opened state, the foreign substances larger than the gap G may be prevented from entering the cartridge case 72. Therefore, by setting the gap G adequately in advance, entry of large-sized foreign substances which may become an obstacle for the rotary motion of the lever member 120 may be inhibited. Since the size of the foreign substances entering through the rod through hole 88 is smaller than the diameter (6 mm, for example) of the rod through hole 88, the gap G is preferably set to be smaller than the diameter of the rod through hole 88.

Then, by providing the predetermined gap G between the opening surface of the rod through hole 88 on the side of the lever member 120 and the contact plane of the lever member 120 in the opened state, even when the user shakes the ink cartridge 40 and the lever member 120 is rotated thereby, the lever member 120 does not collide with the opening surface of the rod through hole 88, so that the deformation or damage of the lever member 120 due to the impact is avoided.

In a case where the lever member 120 is not brought into tight contact with the opening surface of the rod through hole 88 in a state in which the lever member 120 is opened, the distance (gap) between the opening surface of the rod through hole 88 and the contact plane of the lever member 120 becomes uniform by providing the opening surface of the rod through hole 88 in parallel with the contact plane of the lever member 120, the effect of preventing entry of the foreign substances from the rod through hole 88 may be enhanced.

D-2. Second Modification

As in the embodiment described above, when the lever member 120 in the opened state is brought into tight contact with the opening surface of the rod through hole 88 on the side of the lever member 120, a shock absorbing member may be provided at an end portion of the rod through hole 88 on the side of the lever member 120.

Figure 11:
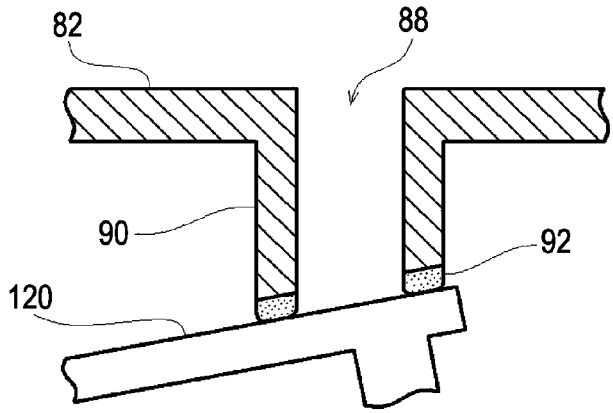
FIG. 11 is an enlarged explanatory drawing of the ink cartridge according to a second modification, showing a portion in the periphery of an opening surface of the rod through hole on the side of the lever member by taking an section of the front case.

FIG. 11 is an enlarged explanatory drawing of the ink cartridge 40 according to a second modification, showing a portion in the periphery of an opening surface of the rod through hole 88 on the side of the lever member 120 by taking an section of the front case. In FIG. 11, the lever member 120 in the opened state is shown. In the ink cartridge 40 according to the second embodiment, the guiding portion 90 is provided on the rod through hole 88 in the same manner as the above-described embodiment (see FIG. 9), and the lever member 120 in the opened state is in tight contact with the opening surface of the rod through hole 88 on the side of the lever member 120. Then, a shock absorbing member 92 formed of rubber or the like is provided at the end portion of the rod through hole 88 coming into contact with the lever member 120.

As described above, by bringing the lever member 120 in the opened state into tight contact with the opening surface of the rod through hole 88, the gap between the rod through hole 88 and the lever member 120 may be eliminated, and hence entry of the foreign substances from the rod through hole 88 into the cartridge case 72 may be prevented. In addition, by providing the shock absorbing member 92 at the end portion of the rod through hole 88 coming into contact with the lever member 120, an impact generated when the lever member 120 comes into contact with the end portion of the rod through hole 88 is alleviated by the shock absorbing member 92. Therefore, even when the lever member 120 in the interior of the ink cartridge 40 is rotated when the user shakes the ink cartridge 40, the lever member 120 is prevented from becoming damaged by the impact.

For reference, the shock absorbing member 92 is capable of alleviating an impact at the time of contact even when provided at a portion coming into contact with the end portion of the rod through hole 88 in a contact plane of the lever member 120.

Although the various embodiments have been descried, the invention is not limited to all of the embodiments described above, and various modes may be employed without departing the scope of the present invention.

Figure 12A:
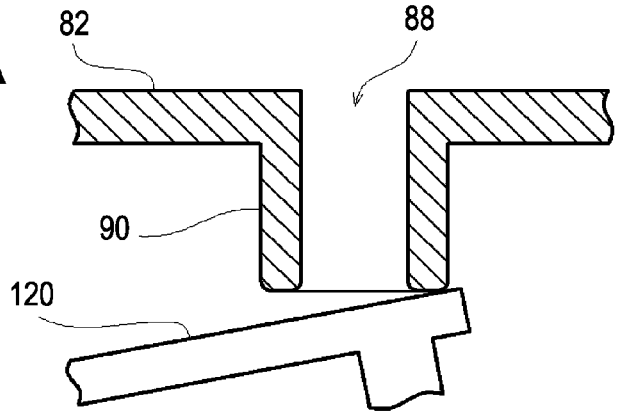
FIGS. 12A and 12B are explanatory drawings showing a case where the opening surface of the rod through hole on the side of the lever member and a contact plane of the lever member are not parallel to each other.

For example, in the embodiment and the modifications described above, the opening surface of the rod through hole 88 on the side of the lever member 120 is provided in parallel with the contact plane of the lever member 120 in the opened state. However, the opening surface of the rod through hole 88 does not necessarily have to be parallel to the contact plane of the lever member 120 as long as a positional relationship in which the opening surface is covered with the lever member 120 in the opened state. For example, as shown in FIG. 12A, although part of the opening surface of the rod through hole 88 and the lever member 120 in the opened state are brought into contact with each other, the opening surface of the rod through hole 88 may be provided in parallel with an outer wall surface of the front case 82 irrespective of the inclined angle of the contact plane of the lever member 120. In this case, since the adjustment of the angle of the opening surface of the rod through hole 88 to match the inclination of the contact plane of the lever member 120 is not necessary, manufacture of the front case 82 is easily achieved.

Figure 12B:
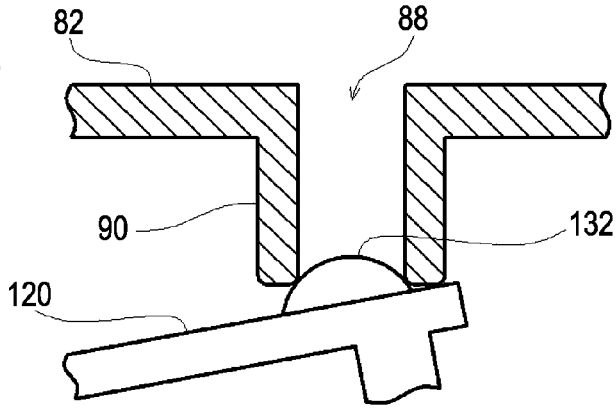

Also, when the opening surface of the rod through hole 88 on the side of the lever member 120 and the contact plane of the lever member 120 are not parallel to each other as in FIG. 12A, the abutting portion 132 having the semi-spherical shape may be provided on the contact plane of the lever member 120 as shown in FIG. 12B. In this configuration, in the state in which the lever member 120 is opened, the abutting portion 132 having the semi-spherical shape comes into abutment with the opened surface of the rod through hole 88, whereby the opening surface may be closed.

Furthermore, in the embodiment described above, in the state in which the ink cartridge 40 is not mounted on the ink jet printer 10, the lever member 120 is urged toward the front case 82 side by the urging spring 108 in such a manner that the lever member 120 covers the opening of the rod through hole 88 on the side of the lever member 120. However, the mode in which the lever member 120 is urged toward the front case 82 is not limited thereto. For example, the lever member may be urged toward the front case 82 using an urging spring provided separately from the urging spring 108 of the liquid chamber 100. In other words, it is sufficient if the lever member 120 is urged so the lever member 120 covers the opening of the rod through hole 88 on the side of the lever member 120 in a state in which the ink cartridge 40 is not mounted on the ink jet printer 10.

What is claimed is:

1. A liquid container mountable on a liquid consuming apparatus having a movable rod movable in an axial direction and a sensor configured to detect a displacement of the movable rod, the liquid container comprising:

a liquid storage portion configured to store liquid;

a liquid chamber provided so as to communicate with the liquid storage portion and partly formed with a deformable portion which is deformable;

a lever member provided so as to be rotatable about a supporting point, configured to partly come into contact with the deformable portion at a position outside of the liquid chamber and to be displaceable in association with the deformation of the deformable portion; and a case member configured to store the liquid storage portion, the liquid chamber, and the lever member in the interior thereof, and having a through hole which allows insertion of the movable rod coming into abutment with the lever member.

2. The liquid container according to claim 1, wherein an opening portion of the through hole on the side of the lever member is covered with the lever member in a state in which the liquid container is not mounted on the liquid consuming apparatus.

3. The liquid container according to claim 2, wherein the through hole is provided with a guiding portion configured to guide the movable rod by an inner wall surface when the movable rod is inserted.

4. The liquid container according to claim 2, wherein the lever member includes a contact plane which is a plane including a abutting portion coming into abutment with the movable rod, and the opening surface of the through hole on the side of the lever member is provided in parallel to the contact plane of the lever member in a state in which the liquid container is not mounted on the liquid consuming apparatus.

5. The liquid container according to claim 2, wherein the opening surface of the through hole on the side of the lever member is provided so as to form a predetermined gap with respect to the lever member in a state in which the liquid container is not mounted on the liquid consuming apparatus.

6. The liquid container according to claim 1, wherein the lever member is urged by a resilient member toward the through hole.

7. The liquid container according to claim 1, wherein one of the opening surfaces of the through hole on the side of the lever member and the lever member is provided with a shock absorbing member at a portion coming into contact with the other.

8. A liquid detecting system configured to detect the presence or absence of liquid in a liquid container mounted on a liquid consuming apparatus, wherein the liquid consuming apparatus includes:

a movable rod movable in an axial direction; and a sensor configured to detect the displacement of the movable rod;

the liquid container includes:

a liquid storage portion configured to store liquid;

a liquid chamber provided so as to communicate with the liquid storage portion and partly formed with a deformable portion which is deformable;

a lever member provided so as to be rotatable about a supporting point, configured to partly come into contact with the deformable portion at a position outside of the liquid chamber and to be displaceable in association with the deformation of the deformable portion; and a case member configured to store the liquid storage portion, the liquid chamber, and the lever member in the interior thereof, and having a through hole which allows insertion of the movable rod coming into abutment with the lever member.

* * * * *